US006488494B2

(12) United States Patent
Lee

(10) Patent No.: US 6,488,494 B2
(45) Date of Patent: Dec. 3, 2002

(54) CANDLE HOLDER

(75) Inventor: Seungsoo Lee, Cliffside Park, NJ (US)

(73) Assignee: Joy World, Inc., Ridgefield Park, NJ (US)

( * ) Notice: Subject to any disclaimer, the term of this patent is extended or adjusted under 35 U.S.C. 154(b) by 0 days.

(21) Appl. No.: 09/764,601

(22) Filed: Jan. 18, 2001

(65) Prior Publication Data

US 2002/0132199 A1 Sep. 19, 2002

(51) Int. Cl.[7] ..... F23D 3/16

(52) U.S. Cl. ..... 431/253; 431/296; 40/452; 40/451

(58) Field of Search ..... 431/253, 259, 431/296; 40/452, 447, 446, 451, 448, 450; 362/161, 415, 253, 447, 800

(56) References Cited

U.S. PATENT DOCUMENTS

| | | | | |
|---|---|---|---|---|
| D132,571 S | | 5/1942 | Scheinpflug | |
| 2,406,777 A | | 9/1946 | Koretzky | |
| 2,503,587 A | | 4/1950 | Murphy | |
| 3,706,523 A | | 12/1972 | Kumm | |
| 3,735,099 A | | 5/1973 | Herr | |
| 4,092,096 A | | 5/1978 | Goto | |
| 4,304,547 A | | 12/1981 | Buzil | |
| 5,067,895 A | | 11/1991 | Chuang et al. | |
| 5,582,578 A | | 12/1996 | Ambrosino | |
| 5,613,760 A | | 3/1997 | Dunn | |
| 5,622,490 A | | 4/1997 | Cheng | |
| 5,673,802 A | * | 10/1997 | Valentino | 211/70 |
| 5,709,045 A | | 1/1998 | Thelen | |
| 5,846,070 A | | 12/1998 | Kim et al. | |
| 6,241,362 B1 | * | 6/2001 | Morrison | 362/231 |
| D452,019 S | * | 12/2001 | Chernyakhovskiy et al. | D26/10 |

FOREIGN PATENT DOCUMENTS

| | | | | |
|---|---|---|---|---|
| BR | 8904667 | * | 3/1991 | A47G/33/00 |

* cited by examiner

*Primary Examiner*—Henry Bennett
*Assistant Examiner*—Kathryn Ferko
(74) *Attorney, Agent, or Firm*—Selitto, Behr & Kim

(57) ABSTRACT

A candle holder includes a housing having a mounting mechanism for mounting a candle to the housing. A display is connected to the housing for selectively displaying one of a plurality of numbers thereon, whereby the candle holder can be re-used for different occasions, such as birthdays and anniversaries, having different numbers associated therewith.

17 Claims, 9 Drawing Sheets

CANDLE HOLDER

FIELD OF THE INVENTION

The present invention relates to candle holders and, more particularly, to a candle holder equipped with a digital display.

BACKGROUND OF THE INVENTION

Candles having shapes in the form of numbers have been used for indicating the age of a person at a birthday party. While these candles enhance amusement at birthday parties or other occasions, the numbers physically shaped thereon cannot be modified or adjusted. As a result, these candles are not re-usable for another person having a different age and have typically been discarded after single use.

U.S. Pat. No. 3,706,523 discloses a birthday candle device equipped with a set of color-coded bands or disks for indicating the age of a person in accordance with an international numerical color code convention. Because the international color code convention is not well known to people in general, the person's age encoded in the bands/disks is not readily recognizable.

U.S. Pat. No. Des. 132,571 discloses a set of candle holders having shapes in the form of numbers ranging from "0" to "9". These candle holders have problems similar to those associated with the numerically shaped candles discussed above.

SUMMARY OF THE INVENTION

The present invention overcomes the disadvantages and shortcomings of the prior art discussed above by providing a new and improved candle holder. More particularly, the candle holder includes a housing having a mounting mechanism for mounting a candle to the housing. A display is connected to the housing for selectively displaying one of a plurality of numbers thereon, whereby the candle holder can be re-used for different occasions, such as birthdays and anniversaries, having different numbers associated therewith.

BRIEF DESCRIPTION OF THE DRAWINGS

For a more complete understanding of the present invention, reference is made to the following detailed description of the present invention considered in conjunction with the accompanying drawings, in which.

DETAILED DESCRIPTION OF THE INVENTION

Figure 1:
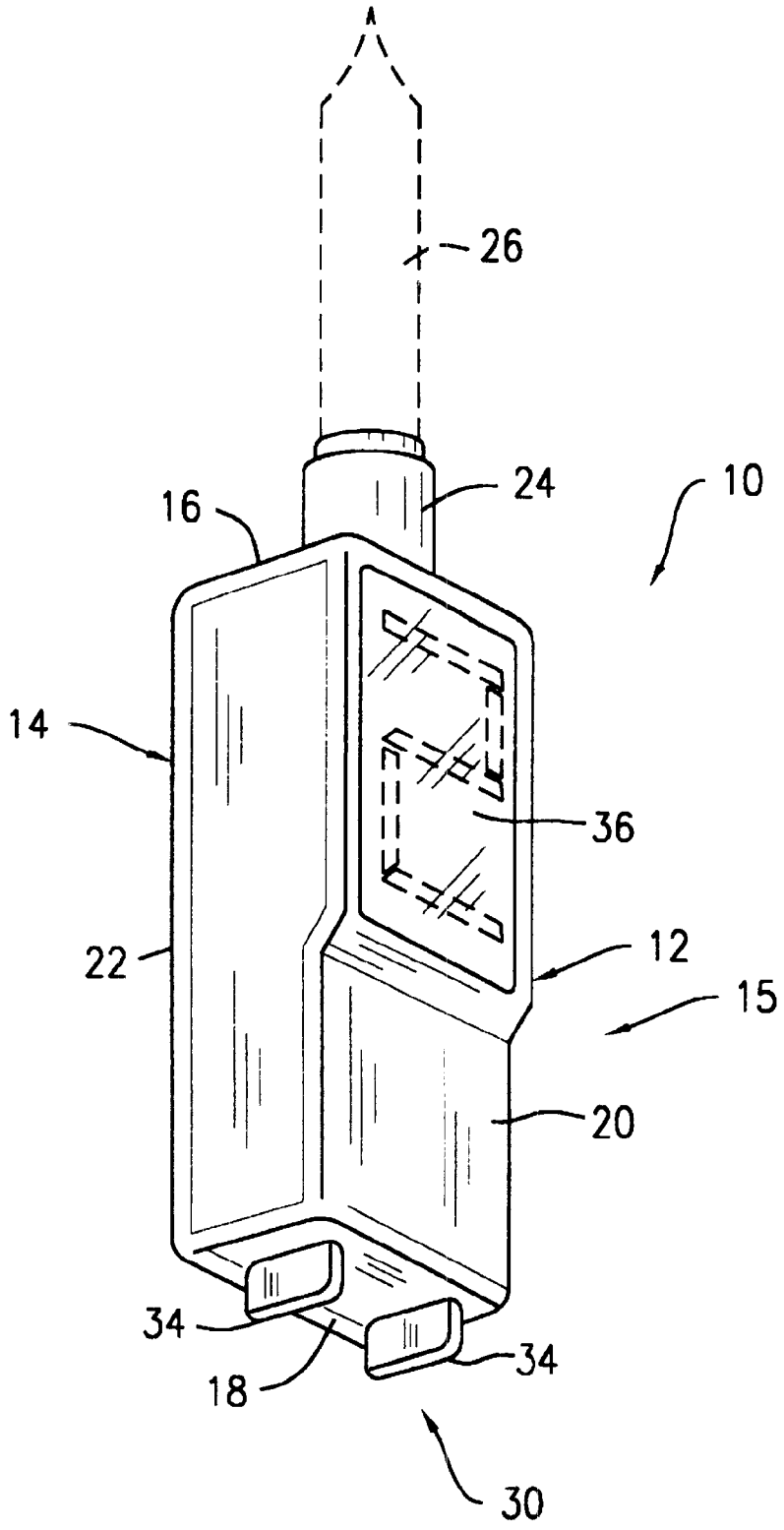
FIG. 1 is a perspective view of a candle holder constructed in accordance with the present invention.

FIGS. 1–7 illustrate a candle holder 10 constructed in accordance with the present invention. More particularly, the candle holder 10 includes front and rear housing sections 12, 14 removably attached to one another by a screw so as to form a housing 15 having upper, lower, front and rear sides 16, 18, 20, 22. A ring 24 is located on the upper side 16 of the housing 15 for receiving a bottom end of a candle 26 so as to support same on the candle holder 10. The ring 24, which is preferably made from metal, has a construction, function and/or operation similar to those of the candle devices disclosed in applicant's U.S. Pat. Nos. 5,363,590 and 5,487,658, the specifications of which are incorporated herein by reference.

With reference to FIGS. 1–7, the candle holder 10 also includes a placement mechanism 30 for securely positioning the candle holder 10 on a cake 32 (see FIG. 2) or other suitable supporting surfaces (e.g., a table). More particularly, the placement mechanism 30 is provided with a pair of bars 34 sized and shaped so as to be imbedded into the cake 32 or positioned on the cake 32.

Figure 2:
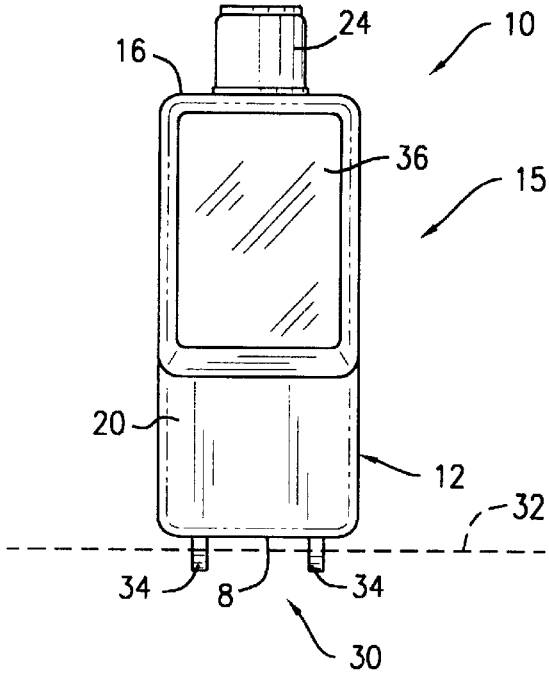
FIG. 2 is a front view of the candle holder shown in FIG. 1.
Figure 3:
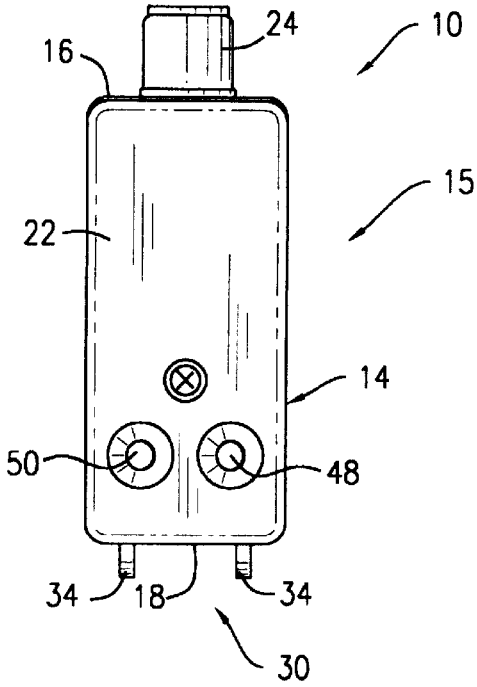
FIG. 3 is a rear view of the candle holder shown in FIGS. 1 and 2.
Figure 4:
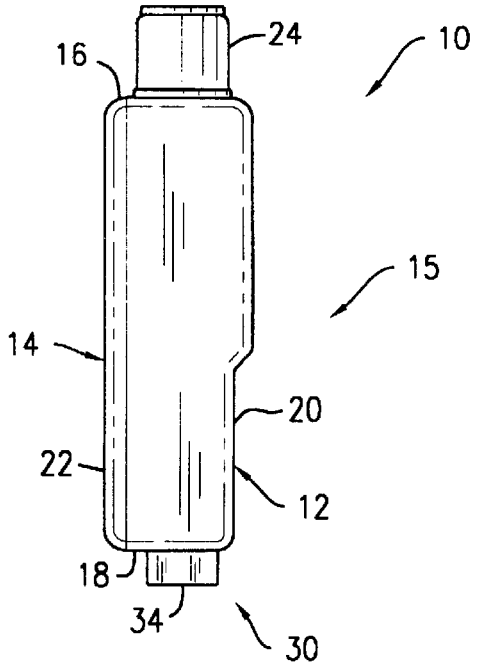
FIG. 4 is a left side view of the candle holder shown in FIGS. 1–3.
Figure 5:
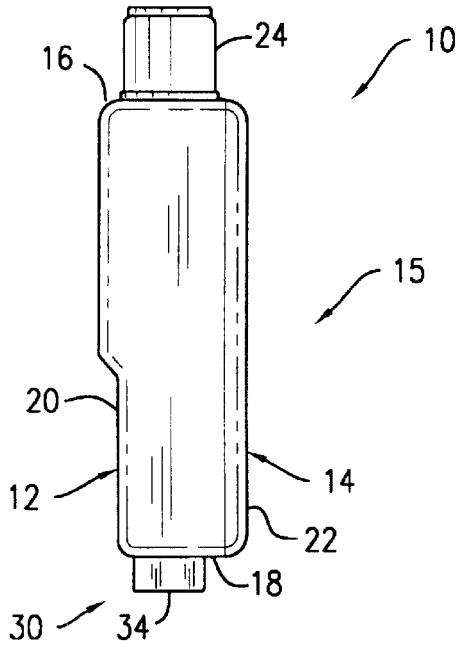
FIG. 5 is a right side view of the candle holder shown in FIGS. 1–4.
Figure 6:
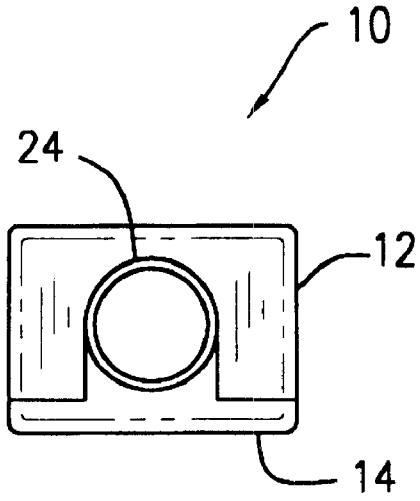
FIG. 6 is a top plan view of the candle holder shown in FIGS. 1–5.
Figure 7:
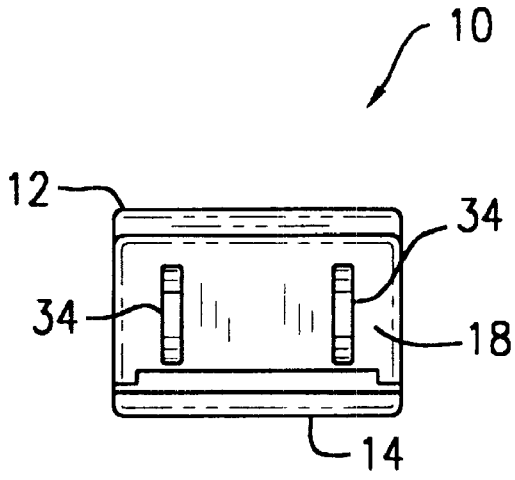
FIG. 7 is a bottom plan view of the candle holder shown in FIGS. 1–6.
Figure 8:
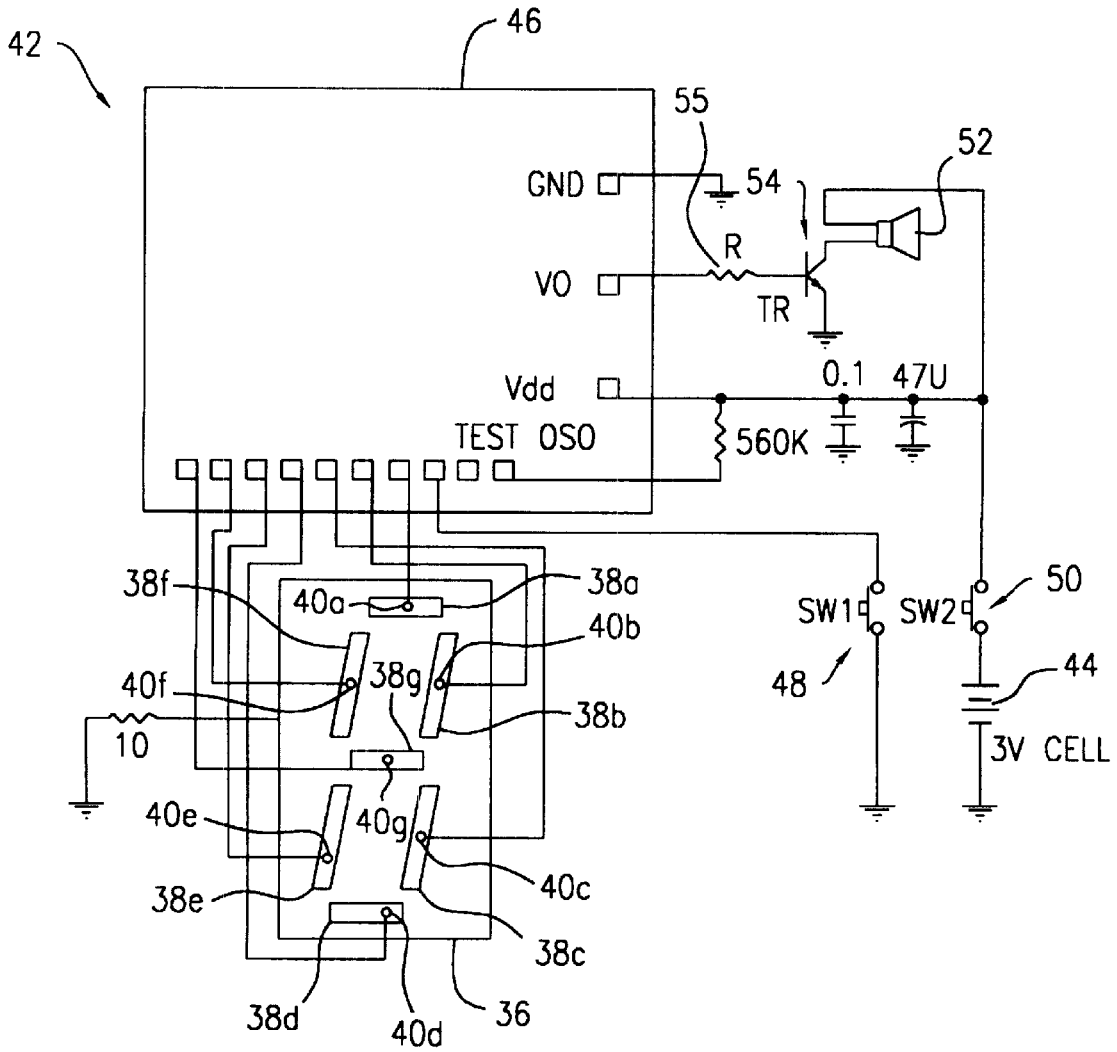
FIG. 8 is a schematic diagram of a control system used in the candle holder shown in FIGS. 1–7.
Figure 9A:
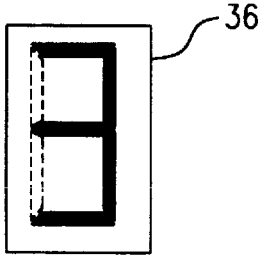
FIGS. 9A–9H are schematic views illustrating the operation of the candle holder shown in FIGS. 1–7.
Figure 9B:
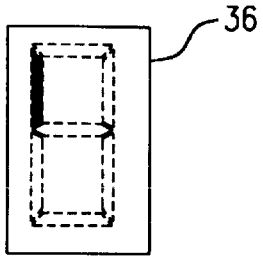
Figure 9C:
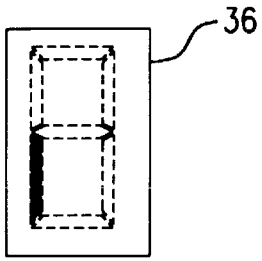
Figure 9D:
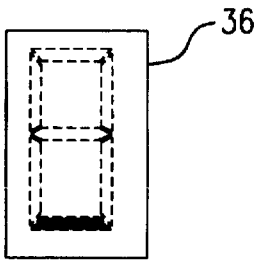
Figure 9E:
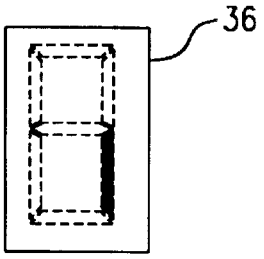
Figure 9F:
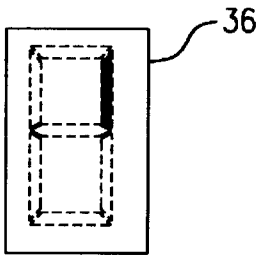
Figure 9G:
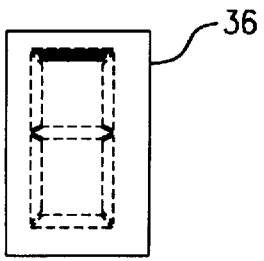
Figure 9H:
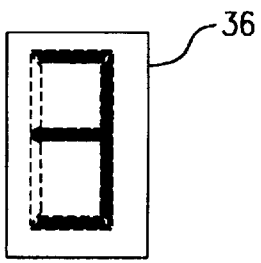

Referring to FIGS. 1, 2 and 8, the candle holder 10 is provided with an electronic display panel 36 on the front side 20 of the housing 15 for selectively displaying a set of numbers ranging from "0" to "9". More particularly, the display panel 36 is preferably a light emitting diode-type display panel and thus has a construction similar to that of a conventional light emitting diode-type display panel. For instance, the display panel 36 includes a plurality of slots 38*a*–38*g* and light emitting diodes 40*a*–40*g* (referred to hereinafter as the "LEDs") arranged in a predetermined manner such that when a preselected set of the LEDs 40*a*–40*g* is activated (i.e., turned on), the display panel 36 displays a number corresponding thereto (see FIG. 8). For instance, when all of the LEDs 40*a*–40*g* are activated, the display panel displays "8". The LEDs 40*a*–40*g* are provided with one or more colors which are conventional in the LED display field. The display panel 36 also includes a protective panel for covering the slots 38*a*–38*g* and LEDs 40*a*–40*g*.

Now referring to FIG. 8, the candle holder 10 is provided with an electric or electronic control system 42 positioned in the housing 15 for controlling the operation of the LEDs 40*a*–40*g*. The control system 42 includes a power source 44 (e.g., batteries) and an integrated circuit unit 46 (referred to hereinafter as the "ICU") which is connected to the LEDs

40*a*–40*g*. The ICU 46 is constructed in a conventional manner to perform functions to be described hereinafter. The control system 42 is also provided with a pair of button-type control switches 48, 50 connected, either directly or indirectly, to the ICU 46 and located on the rear side 22 of the housing 15 for controlling the operation of the ICU 46 and hence the LEDs 40*a*–40*g* (see FIG. 3). More particularly, the ICU 46 is pre-programmed such that when it is in its "deactivated" state, none of the LEDs is activated (i.e., lighted or turned on), and no visible number is thus displayed on the display panel 36. The ICU 46 is adapted to be in its "activated" state when the switch 48 is pressed (i.e., activated/closed) by a user and a control signal is transmitted to the ICU 46 in response thereto. In its "activated" state, the ICU 46 is preprogrammed to turn on a preselected set of the LEDs 40*a*–40*g*, thereby causing the display panel 36 to display a number corresponding thereto. The LEDs 40*a*–40*g* activated by the ICU 46 and hence the corresponding number displayed on the display panel 36 can be adjusted by repeatedly pressing the switch 48. The following table illustrates the operation of the LEDs 40*a*–40*g* and the numbers displayed on the display panel 36 in relation to the activation of the switch 48.

| Number of Times the Switch 48 is Pressed | LEDs Activated | Number Displayed on the Display Panel 36 |
|---|---|---|
| None | None (ICU in its "deactivated" state) | None (ICU in its "deactivated" state) |
| Once | LEDs 40a–40f | "0" |
| Twice | LEDs 40b, 40c | "1" |
| Three Times | LEDs 40a, 40b, 40d, 40e, 40g | "2" |
| Four Times | LEDs 40a–40d, 40g | "3" |
| Five Times | LEDs 40b, 40c, 40f, 40g | "4" |
| Six Times | LEDs 40a, 40c, 40d, 40f, 40g | "5" |
| Seven Times | LEDs 40a, 40c–40g | "6" |
| Eight Times | LEDs 40a–40c | "7" |
| Nine Times | LEDs 40a–40f | "8" |
| Ten Times | LEDs 40a–40c, 40f, 40g | "9" |
| Eleven Times | None (ICU returned to its "deactivated" state) | None (ICU returned to its "deactivated" state) |

As indicated in the foregoing table, when the ICU 46 is in its "deactivated" state, the display panel 36 does not display any visible number (i.e., none of the LEDs 40*a*–40*g* is turned on). When the switch 48 is pressed once, the ICU 46 causes the LEDs 40*a*–40*f* to be activated, and the display panel 36 displays "0". If the switch 48 is subsequently pressed one more time (i.e., twice from the ICU "deactivated" state), the LEDs 40*b*, 40*c* are activated by the ICU 46, and the display panel 36 displays "1". The remaining numbers (i.e., from "3" to "9") are selected by repeatedly pressing the switch 46 until the desired number is displayed on the display panel 36.

Referring to FIGS. 9A–9H, the control system 42 of the candle holder 10 is adapted to provide additional visual effects. More particularly, the ICU 46 is preprogrammed to cause the number being displayed on the display panel (e.g., "3") to blink or flash a preselected number of times (e.g., once) and then sequentially activate the LEDs 40*a*–40*f* in a counter-clockwise direction (see FIGS. 9B–9G). In this manner, the display panel 36 provides a visual effect in the form of "moving" lights. Alternatively, the LEDs 40*a*–40*f* can be sequentially activated in a clockwise direction. Once the LEDs have been sequentially activated, the number (e.g., "3") re-appears on the display panel 36 (see FIG. 9H). The blinking and sequential activation cycle described above continues to repeat until the ICU 46 is deactivated by pressing the switch 48 an appropriate number of times (see the table hereinabove).

With reference to FIG. 8, the candle holder 10 is also provided with additional mechanisms for generating other special effects so as to enhance amusement. For instance, the candle holder 10 is provided with a sound generating unit 52 (e.g., a speaker), a transistor 54 and a resistor 55 connected, either directly or indirectly, to the ICU 46 and the switch 48 such that when the ICU 46 is in its "activated" state, the sound generating unit 52 produces a series of predetermined sounds (e.g., a "Happy Birthday to You" tune). The candle holder 10 can also be provided with light units (e.g., flashing or blinking lights) for generating additional special effects.

Figure 10:
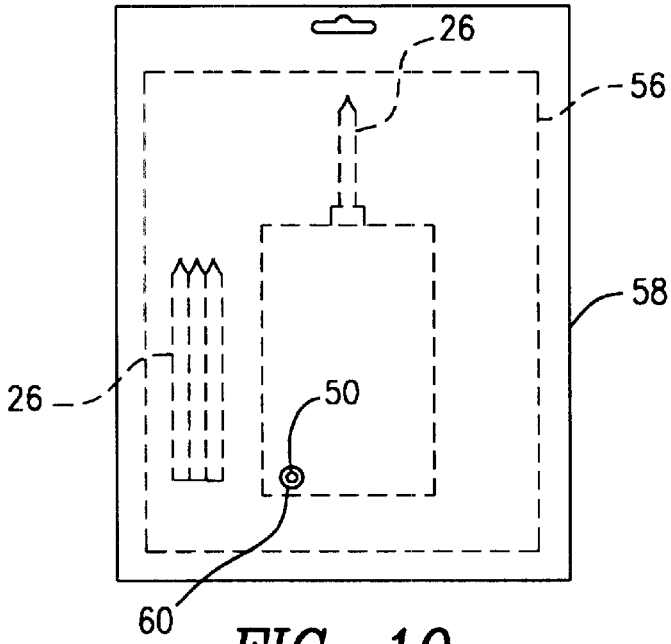
FIG. 10 is a rear view of a package containing the candle holder shown in FIGS. 1–7.

Still referring to FIG. 8, the switch 50 is used for testing or illustrating the operation of the candle holder 10. More particularly, the switch 50 is connected to the ICU 46 such that when it is pressed (i.e., activated/closed), it sends a control signal to the ICU 46 so as to cause the display panel 36 to display a predetermined number in blinking fashion. After the lapse of a predetermined time, the ICU 46 is deactivated and turns all of the LEDs 40*a*–40*g* off. The candle holder 10 remains in its "deactivated" state until either the switch 48 or the switch 50 is pressed by a user. The candle holder 10 is packaged for sale such that the switch 50, but not the switch 48, is accessible to consumers. For instance, the candle holder 10 can be packaged in a plastic cover 56 (see FIG. 10) enclosed by a paper/cardboard panel 58 which has an opening 60 aligned with the switch 50. In this manner, the candle holder 10 can be "test-run" by a consumer prior to purchase. The candle holder 10 can be packaged for sale along with conventional candles 26 (e.g., birthday candles), as shown in FIG. 10.

When used at a birthday party, the candle holder 10 is placed on a cake or other suitable object or areas. The switch 48 is pressed an appropriate number of times so that the number corresponding to the age of a person appears on the display panel 36. After use, the switch 48 is repeatedly pressed until the candle holder 10 is deactivated.

It should be appreciated that the candle holder 10 provides numerous advantages. For instance, because the number displayed on the display panel 36 can be easily adjusted or changed by pressing the switch 48, it can be re-used for many different occasions (e.g., birthdays, anniversaries, etc.). Moreover, the candle holder 10 is adapted for use in connection with any conventional candles.

Figure 12:
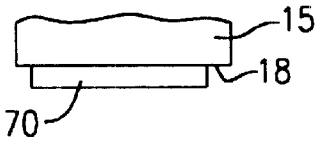
FIG. 12 is a sectional view of a second modified version of the candle holder shown in FIGS. 1–7.
Figure 13:
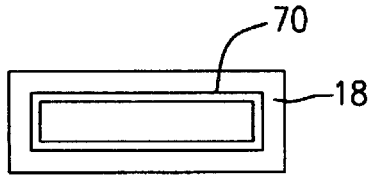
FIG. 13 is a bottom view of the modified candle holder shown in FIG. 12.
Figure 14:
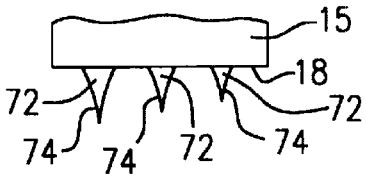
FIG. 14 is a sectional view of a third modified version of the candle holder shown in FIGS. 1–7.
Figure 15:
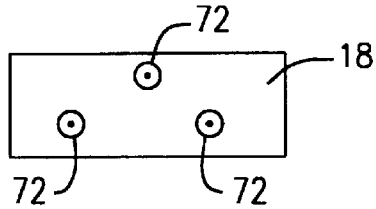
FIG. 15 is a bottom view of the modified candle holder shown in FIG. 14.
Figure 11:
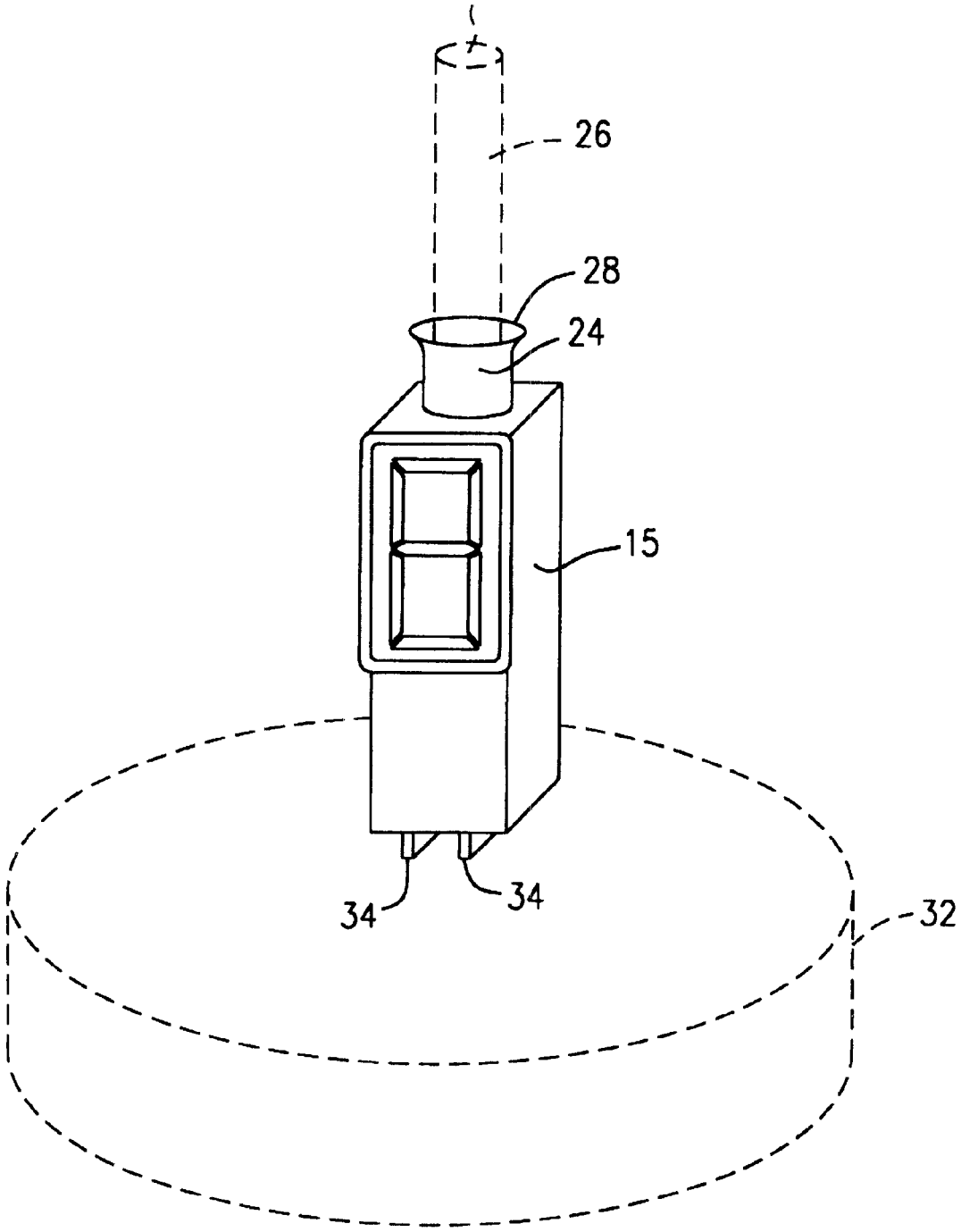
FIG. 11 is a perspective view of a first modified version of the candle holder shown in FIGS. 1–7.
Figure 16:
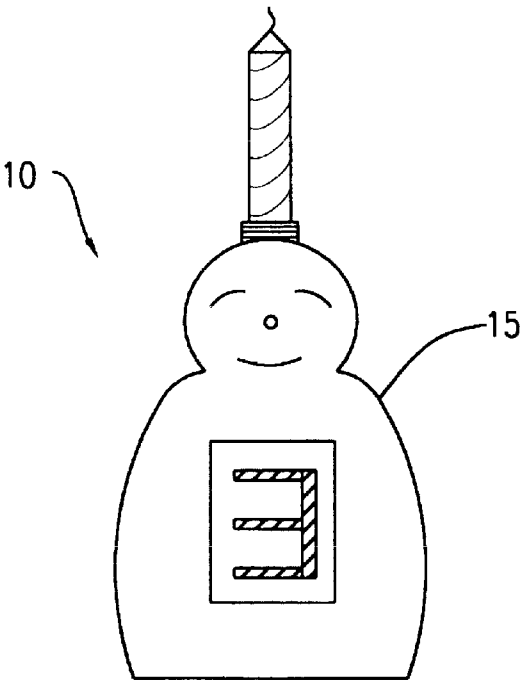
FIG. 16 is a view illustrating a fourth modified version of the candle holder shown in FIGS. 1–7.
Figure 17:
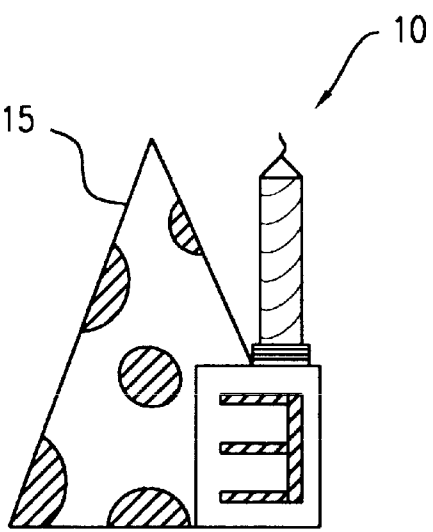
FIG. 17 is a view illustrating a fifth modified version of the candle holder shown in FIGS. 1–7.
Figure 18:
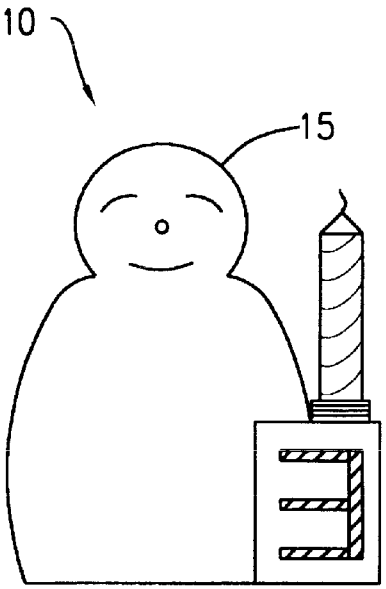
FIG. 18 is a view illustrating a sixth modified version of the candle holder shown in FIGS. 1–7.

It should be noted that the present invention can have numerous modifications and variations. For instance, the sound generating unit 52 can be eliminated from the candle holder 10. The candle holder 10 can also be arranged with one or more identical candle holders in a side-by-side manner so as to display any number having more than one digit. Alternatively, the display panel 36 can be modified in such a way that it can display numbers having one or more digits (e.g., the display panel 36 can display numbers ranging from 0 to 100). Further, the ICU 46 can be modified or replaced with a different control mechanism. By way of example, the ICU 46 can be modified to display the numbers in a sequence different from the one illustrated in the table above (e.g., off-1-2-3-4-5-6-7-8-9-0-off sequence). The ring 24 of the candle holder 10 can also be replaced with other candle-mounting mechanisms and/or be provided with a flared section (see reference numeral 28 in FIG. 11) for forming a trough sized and shaped so as to hold liquefied wax dropping from the candle 26, thereby inhibiting liquefied wax from being dropped on the housing 15. The placement mechanism 30 can also be modified or be provided with a different structure or configuration. For instance, FIGS. 12 and 13 illustrate a single placement member 70 projecting from the lower side 18 of the candle holder housing 15 and having a rectangular shape. FIGS. 14 and 15 illustrate placement members 72, each of which projects from the lower side 18 of the candle holder housing 15 and has a pointed tip 74. Moreover, the housing 10 of the present invention can be provided with many different shapes (see, for instance, FIGS. 16–18) for enhancing amusement at parties and/or gatherings. In addition, the display panel 10 can be equipped with a different type of display mechanism. For example, other electronic displays (e.g., a liquid crystal display) and mechanical or electromechanical displays (e.g., slides having different numbers thereon and removably mounted to or in the housing 15) can be used in conjunction with the present invention.

It will be understood that the embodiment(s) described herein is merely exemplary and that a person skilled in the art may make many variations and modifications without departing from the spirit and scope of the invention. All such variations and modifications, including those discussed above, are intended to be included within the scope of the invention as defined in the appended claims.

I claim:

1. A candle holder comprising a housing having mounting means for mounting a candle to said housing and supporting means for supporting said housing on a cake, said supporting means including a member depending from said housing and sized and shaped so as to be embedded into a surface of a cake; a display connected to said housing for selectively displaying one of a plurality of numbers thereon, whereby said candle holder can be re-used for different occasions having different numbers associated therewith; and control means for electronically controlling said display so as to selectively display one of said plurality of numbers on said display, said control means including an integrated circuit unit and a power source, which are mounted in said housing, and said control means including a first switch, which is connected to said integrated circuit unit for selectively causing said display to display one of said plurality of numbers, and a second switch, which is connected to said integrated circuit unit for testing said display.

2. A candle holder comprising a housing having mounting means for mounting a candle to said housing and supporting means for supporting said housing on a cake, said supporting means including a member depending from said housing and sized and shaped so as to be embedded into a surface of a cake; and a display connected to said housing for selectively displaying one of a plurality of numbers thereon, whereby said candle holder can be re-used for different occasions having different numbers associated therewith, said display including a plurality of light units arranged so as to be selectively activated for displaying one of said plurality of numbers, said display including a plurality of slots formed in said housing, and each of said light units being associated with a corresponding one of said slots such that, when activated, said light units illuminate said slots.

3. The candle holder of claim 2, wherein each said light units is a light emitting diode.

4. The candle holder of claim 2, further comprising control means for controlling said display so as to selectively display one of said plurality of numbers on said display.

5. The candle holder of claim 4, wherein said display is electronically controlled by said control means.

6. The candle holder of claim 5, wherein said control means includes an integrated circuit unit, which is mounted in said housing, and a power source, which is mounted in said housing.

7. The candle holder of claim 6, wherein said control means includes a first switch connected to said integrated circuit unit for selectively causing said display to display one of said plurality of numbers.

8. The candle holder of claim 7, wherein said control means includes a second switch connected to said integrated circuit unit for testing said display.

9. The candle holder of claim 4, further comprising sound producing means connected to said control means for generating a sound.

10. A candle holder comprising a housing having mounting means for mounting a candle to said housing and supporting means for supporting said housing on a cake, said supporting means including a member depending from said housing and sized and shaped so as to be embedded into a surface of a cake; and a display connected to said housing for selectively displaying one of a plurality of numbers thereon, whereby said candle holder can be re-used for different occasions having different numbers associated therewith, said display including a liquid crystal display.

11. The candle holder of claim 10, further comprising a control system electrically connected to said display, said display being controlled by said control system such that a desired one of said plurality of numbers can be displayed on said display.

12. A candle holder comprising a housing having mounting means for mounting a candle to said housing and supporting means for supporting said housing on a cake, said supporting means Including a member depending from said housing and sized and shaped so as to be embedded into a surface of a cake; a display connected to said housing for selectively displaying one of a plurality of numbers thereon, whereby said candle holder can be re-used for different occasions having different numbers associated therewith; and a control system electrically connected to said display, said display being controlled by said control system such that a desired one of said plurality of numbers can be displayed on said display, said control system being located in said housing and including an integrated circuit unit and a power source, which are mounted in said housing, and said control system including a switch connected to said integrated circuit unit for selectively causing said display to display a desired one of said plurality of numbers.

13. The candle holder of claim 12, wherein said display includes a plurality of light units arranged so as to be selectively activated for displaying one of said plurality of numbers.

14. A candle holder comprising a housing having mounting means for mounting a candle to said housing and supporting means for supporting said housing on a cake, said supporting means including a member depending from said housing and sized and shaped so as to be embedded into a surface of a cake; a display mounted to said housing and electronically controlled so as to selectively display one of a plurality of preselected numbers thereon; and a control system electrically connected to said display, said display being controlled by said control system such that a desired one of said plurality of preselected numbers can be displayed on said display, said control system being located in said housing and including an integrated circuit unit and a power source, which are mounted in said housing, and said control system including a first switch, which is connected to said integrated circuit unit for selectively causing said display to display a desired one of said plurality of preselected numbers, and a second switch, which is connected to said integrated circuit unit for testing said display.

15. The candle holder of claim 11, wherein said control system is located in said housing.

16. The candle holder of claim 15, wherein said control system includes an integrated circuit unit, which is mounted in said housing, and a power source, which is mounted in said housing.

17. The candle holder of claim 16, wherein said control system includes a first switch, which is connected to said integrated circuit unit for selectively causing said display to display a desired one of said plurality of numbers, and a second switch, which is connected to said integrated circuit unit for testing said display.

* * * * *